United States Patent [19]

Harder

[11] 4,316,612

[45] Feb. 23, 1982

[54] EDUCATIONAL ALGEBRA BOARD GAME

[76] Inventor: Kenneth J. Harder, 113 Ninth St., Bay St. Louis, Miss. 39520

[21] Appl. No.: 130,232

[22] Filed: Mar. 14, 1980

[51] Int. Cl.[3] ..... A63F 3/00

[52] U.S. Cl. ..... 273/272; 434/191; 434/207

[58] Field of Search ..... 273/272; 35/31 F; 434/191, 204, 207

[56] References Cited

U.S. PATENT DOCUMENTS

| | | | |
|---|---|---|---|
| 1,415,019 | 5/1922 | Crossland | 35/31 F |
| 2,320,832 | 6/1943 | Schoenberg et al. | 35/31 F UX |
| 3,267,590 | 8/1966 | Browning | 273/272 |
| 3,606,336 | 9/1971 | Krause | 273/272 |
| 3,904,207 | 9/1975 | Gold | 273/272 |
| 3,984,108 | 10/1976 | Marzo | 273/272 |
| 4,155,556 | 5/1979 | Falcione | 273/272 |

*Primary Examiner*—Anton O. Oechsle

[57] ABSTRACT

An educational board game for up to four players. The game equipment includes a square game board, a plurality of strips on each of which is printed an algebraic equation or inequality to be solved. The strips are color coded to reflect the relative difficulty of the equations and inequalities thereon. A plurality of similarily coded markers are also provided. Each marker has printed thereon a portion of an equation or inequality. The board is provided with areas adjacent each side which are demarcated to receive, firstly, an equation or inequality strip and, secondly, a plurality of markers which are placed on the board during the play of the game by the players in their efforts to solve the associated equation or inequality. The equipment also includes a plurality of timers having different timing periods, a selected one of which is used to time the game. After a timing period, the board is rotated 90 degrees to allow the players to check the work of each other.

5 Claims, 4 Drawing Figures

EDUCATIONAL ALGEBRA BOARD GAME

SUMMARY

Equation Rotation—an Algebra Game—is a game for four players who use equation markers to solve linear equations, linear inequalities, or quadratic equations which are printed on equation strips. This is an instructional game played in a classroom setting for students in a first-year algebra class, however, second-year students may use it for remedial or review work. After each round of play, the entire game board is rotated ninety degrees clockwise, giving each player time to correct previous play and play on the equation in front of him until all equations and/or inequalities are completely solved. The appropriate sand timer is used to keep the game at a moderate pace.

DESCRIPTION OF THE DRAWINGS

The enclosed drawing depicts the different game parts. The total number of parts is listed and described in the Detailed Description of this specification.

How the game parts are interrelated and used in a particular level of play is also described in the Detailed Description and is further described in the Game Directions to be included with the game.

DETAILED DESCRIPTION

Figure 4:
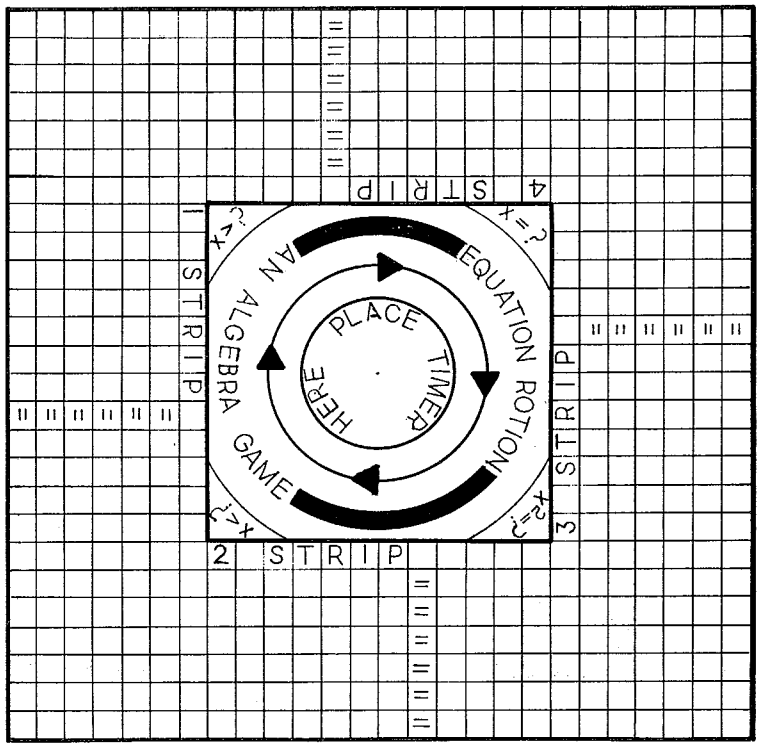
FIG. 4 shows the game board which is also explained in the Detailed Description.

Equation Rotation—an Algebra Game—consists of one game board (see drawing FIG. 4) which is made of sturdy yellow illustration board with markings in black. The center is bordered with a 12 cm square within which the sand timer and the equation markers are placed. The equation strips are inserted in rubber loops on this border as noted on the game board and on the drawings.

Figure 3:
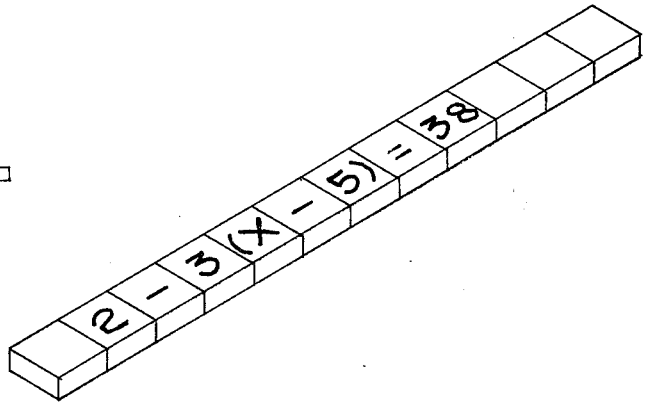
FIG. 3 shows an equation strip which is also explained in the Detailed Description.

There are twenty equation strips (see drawing FIG. 3) four each of green, blue, red, brown, and orange. They are made of wood and painted the appropriate colors to match the equation markers; the equations and inequalities are printed in black on the face of each equation strip. The placement and the use of these equation strips is also explained in the Game Directions.

Figure 2:
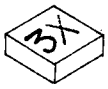
FIG. 2 shows an equation marker. The total number, color, material, and markings are also described in the Detailed Description.

There are 83 green, 114 blue, 165 red, 124 brown and 115 orange equation markers (see drawing FIG. 2) made of the same material and painted to match the equation strips. These are the "playing pieces" that the players use to solve the equations of inequalities. (more explanation is also given in the Game Directions.) There are various markings on them such as 3×, 2, −, +, (,), etc. printed in black.

Figure 1:
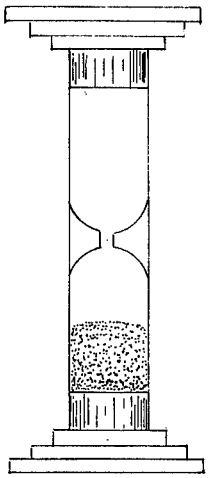
FIG. 1 shows a sand timer (1 inch diameter by $3\frac{1}{2}$ inches high) which is used to time the action of each play. The type, the material, length of time, etc. is explained in the Detailed Description.

There are three sand timers (see drawing FIG. 1) which are commercially purchased, made of plastic and glass with colored sand in the middle. When turned upside down, the sand flows through, timing the action of the "play". Depending on the level of play in the game (also described more fully in the Game Directions) there is a one minute, a two minute, and a three minute timer. There is a set of game directions; game description and teacher instruction; and a cardboard box to contain all of the above mentioned game parts.

Printed on the Equation Strips are:

| Green (Easy) | | Blue (Medium) | |
|---|---|---|---|
| 1. | $5x - 3 = 17$ | 1. | $2(2x - 1) = 3x + 1$ |
| 2. | $-3x + 8x - 22 = 3$ | 2. | $2 - 3(x - 5) = 38$ |
| 3. | $12x - 15 = 9x - 6$ | 3. | $x + (3x + 2) = 10$ |
| 4. | $12x - 3 - 2x = 47$ | 4. | $2(x + 5) - x = 7$ |
| **Red (Difficult)** | | **Orange** | |
| 1. | $5x - (2x + 7) = 11$ | 1. | $x^2 + 11x + 18 = 0$ |
| 2. | $6x - 3(x + 2) = 2(x + 4)$ | 2. | $x^2 - 9 = 0$ |
| 3. | $5x - 2(x - 6) = 26 + x$ | 3. | $x^2 - 8x + 16 = 0$ |
| 4. | $6x - 3(x + 1) = 2(x + 2)$ | 4. | $x^2 - 5x = 24$ |

Printed on the inequality strips:

| Brown | |
|---|---|
| 1. | $10x + 16 > x - 20$ |
| 2. | $-2x - 6 > 4$ |
| 3. | $10x - (7x - 7) \leqq 3$ |
| 4. | $-2x - 3(2x - 1) < 27$ |

Following are the three printed sheets to be included with the game. This Game Directions and Game Description has been copyrighted 1979.

EQUATION ROTATION - An Algebra Game

Copyright © 1979—by Kenneth J. Harder

DIRECTIONS

1. Select the level of play.

A. Linear Equations - Green (Easy), Blue (Medium), or Red (Difficult) Use 1 minute timer.

B. Linear Inequalities - Brown - Use 2 minute timer.

C. Quadratic Equations - Orange - Use 3 minute timer.

Insert equation strips in game board matching the numbers on the gameboard. (Orange strips use orange markers, etc.)

2. Place equation markers face down in center of gameboard; each player picks 12 markers placing face up in front of you. (If blank marker is picked, player gets a bonus of picking 2 additional markers—blank markers are not used in play unless playing Equation Rotation Wild.) Place appropriate timer in the middle circle.

3. Play the equation markers on the equation or inequality in front of you. (Of course, replacing the "=" for the correct inequality sign when playing inequalities.) Score one point for each marker used correctly. After the time is up, rotate the gameboard 90° clockwise.

4. Check the work from the previous play; if incorrect, remove markers, returning to the center face down, and subtract one point for each wrong marker from previous player's score. Draw enough markers from center to maintain a minimum of 12 markers before each play. (Drawing a blank marker, see rule #2) Turn sand timer over continuing play on the equation in front of you.

5. Continue above procedures until all equations or inequalities are solved correctly. A player whose last play correctly completes the solution receives a bonus of 5 points. Player with the highest score wins the game.

6. Equation Rotation Wild is played as regular Equation Rotation with the exception that the blank markers are used as wild markers (like wild playing cards.) (This version of the game shouldn't be played until the regular game is mastered.) Score 2 points for each blank marker used—player must be able to defend its use.

The game is played by four players and for a class of 25–30, four games could be used with students waiting their turn to play.

I claim:

1. An educational algebra game article comprising a generally square game board, a plurality of strips each having printed thereon an equation or inequality to be solved, and a plurality of markers having printed thereon portions of equations or inequalities, said portions being so related to respective ones of said strip equations or inequalities that selected ones of said markers can be assembled to form a successive series of equations or inequalities the last of which constitutes a solution for the related strip equation or inequality, said board including demarcated areas adjacent each side thereof for receiving one of said strips and an adjacent assembly of said markers.

2. The article as defined in claim 1, and further including means for timing the play of the game.

3. The article as defined in claim 2 wherein said timing means includes a plurality of timers having different timing periods, a selected one of which is used to time the play of the game as desired.

4. The article as defined in claim 2 wherein said board is further provided with a central area for receiving said timing means and a random unassembled array of said markers.

5. The article as defined in claim 1 wherein said strips are provided in groups each having inequalities or equations of selected difficulties, said strips being color coded to identify them as members of the various groups, and said markers being provided in correspondingly color coded groups.

* * * * *

| SAMPLE EQUATIONS | | |
|---|---|---|
| (1) $3x - 7 + 2x = 23$ | (2) $3 - 2(x - 7) = 29$ | (3) $x^2 - 6x = 27$ |
| $5x - 7 = 23$ | $3 - 2X + 14 = 29$ | $x^2 - 6x - 27 = 27 - 27$ |
| $5x - 7 + 7 = 23 + 7$ | $17 - 2x = 29$ | $x^2 - 6x - 27 = 0$ |
| $5x = 30$ | $17 - 2x - 17 = 29 - 17$ | $(x - 9)(x + 3) = 0$ |
| $x = 6$ | $-2x = 12$ | $x = 9\ x = -3$ |
| | $x = 16$ | |

| SAMPLE INEQUALITIES | |
|---|---|
| (1) $10x + 9 > 6x - 3$ | (2) $-7(x - 1) > 21$ |
| $10x + 9 - 6x > 6x - 3 - 6x$ | $-7x + 7 > 21$ |
| $4x + 9 > -3$ | $-7x + 7 - 7 > 21 - 7$ |
| $4x + 9 - 9 > -3 - 9$ | $-7x > 14$ |
| $4x > -12$ | $x > -2$ |
| $x > -3$ | |

NOTE:
Reversal of inequality

GAME DESCRIPTION

A. General

Equation Rotation—an Algebra Game is a challenging and stimulating game for students in either first-year Algebra or second-year. The game is played by four players who improve their skills in solving, step by step, linear equations, linear inequalities, and quadratic equations (solved by factoring). Grades 8–12.

B. For the teacher

The linear equations are divided into three sections. The green (easy) consists of simple linear equations in one variable with the variable on one side and with the variable on both sides of the equation. The blue (medium) consists of equations with parenthesis on one side of the equation and the red (difficult) consists of equations with parenthesis on both sides of the equation.

The linear inequalities (brown) consists of variables on both sides, parenthesis on one side and making use of the reversal of the inequality sign where applicable.

The quadratic equations (orange) are simple ones solved using factoring and the zero product principle. Positive and/or negative roots may occur on any level of play.